US007146867B2

(12) United States Patent
Jagdhuber

(10) Patent No.: US 7,146,867 B2
(45) Date of Patent: Dec. 12, 2006

(54) PROPORTIONING DEVICE

(75) Inventor: Bernd Jagdhuber, Uetersen (DE)

(73) Assignee: Eppendorf AG, Hamburg (DE)

( * ) Notice: Subject to any disclaimer, the term of this patent is extended or adjusted under 35 U.S.C. 154(b) by 60 days.

(21) Appl. No.: 10/758,169

(22) Filed: Jan. 15, 2004

(65) Prior Publication Data

US 2004/0149052 A1 Aug. 5, 2004

(30) Foreign Application Priority Data

Jan. 16, 2003 (DE) ..... 103 01 343

(51) Int. Cl.
*B01L 3/02* (2006.01)

(52) U.S. Cl. ..... 73/863.32; 73/863.31; 73/864.01; 73/864.02; 422/99; 422/100

(58) Field of Classification Search ..... 73/1.36, 73/1.73, 1.74, 863.31, 863.32, 864, 864.01, 73/864.02, 864.11, 864.13, 864.18; 422/99, 422/100

See application file for complete search history.

(56) References Cited

U.S. PATENT DOCUMENTS

| | | | | |
|---|---|---|---|---|
| 4,519,258 | A * | 5/1985 | Jakubowicz | 73/864.16 |
| 4,750,373 | A * | 6/1988 | Shapiro | 73/864.87 |
| 5,389,341 | A | 2/1995 | Tuunanen et al. | 422/100 |
| 5,620,661 | A * | 4/1997 | Sch urbrock | 422/100 |
| 6,299,841 | B1 * | 10/2001 | Rainin et al. | 422/100 |
| 2002/0011815 | A1 * | 1/2002 | Gaffney et al. | 318/560 |
| 2002/0095998 | A1 * | 7/2002 | Kriz et al. | 73/864.18 |
| 2004/0099067 | A1 * | 5/2004 | Chen et al. | 73/863.32 |

FOREIGN PATENT DOCUMENTS

| | | |
|---|---|---|
| DE | 693 13 737 T2 | 6/1993 |
| EP | 0 576 967 B1 | 1/1994 |

OTHER PUBLICATIONS

"Flexiforce Sensor", Tekscan, Dec. 9, 2002, available on the Internet at <http://web.archive.org>.*
"Flexiforce Applications", Tekscan, Aug. 9, 2002, available on the Internet at <http://web.archive.org>.*

* cited by examiner

*Primary Examiner*—Hezron Williams
*Assistant Examiner*—David A. Rogers
(74) *Attorney, Agent, or Firm*—Vidas, Arrett & Steinkraus, P.A.

(57) ABSTRACT

A proportioning device, comprising a manually operable actuating device, a sensor associated with the actuating device for detecting a force manually exerted on the actuating device, an electric driving motor, an electric control connected to the sensor and electric driving motor for controlling the driving motor during the detection by the sensor of a force exerted on the actuating device, an electric voltage supply connected to the sensor, electric driving motor, and electronic control, and a displacement device coupled to the actuating device and electric driving motor for proportioning a liquid.

18 Claims, 1 Drawing Sheet

PROPORTIONING DEVICE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a proportioning device.

Proportioning devices are employed to proportion liquids at laboratories. They generally have a displacement device with a displacement member which, when shifted, causes a liquid or air column to be moved. They are specifically known in the following designs:

Proportioning devices operating according to the air-cushion principle have a piston-and-cylinder unit by means of which an air column can be shifted to draw liquid into a pipette tip or expel it therefrom. The piston-and-cylinder unit does not contact the liquid here. Only the pipette tip, which is mostly made of plastic material, is wetted and may be exchanged after use.

On the contrary, proportioning devices operating as direct displacers have a syringe which is filled with a sample liquid. The piston and cylinder of the syringe are wetted by the liquid so that the syringe mostly is replaced with a new syringe or is cleaned before another liquid is proportioned. The syringe is also made of plastic material in most cases.

No-piston proportioning devices, for example, have a pipette tip with a balloon-like end portion which is expanded to draw in liquid and is compressed to expel it. Known pipette tips are disposable.

Dispensers are proportioning devices which are able to repetitively dispense an amount of a liquid they received, in small sub-amounts.

Furthermore, there are multi-channel proportioning devices which comprise a plurality of proportioning devices to proportion several amounts of liquid at the same time.

Air-cushion, direct displacer, and no-piston proportioning devices can exhibit an invariable or variable volume to be proportioned. A variation of the volume to be proportioned is mostly achieved by varying the displacement of the displacement device. For this purpose, the path of shift of the piston may be varied, for example, or the degree of deformation of the balloon-like end portion may be varied or the displacement device may be exchanged.

The displacement device of manual proportioning devices is solely driven by the physical force of the user. This has the advantages below:

The operator receives a tactile return information. Each variation of the force required for actuation is noticed immediately. Thus, the operator can check whether the proportioning device operates correctly. The operator can vary the speed of liquid reception and delivery directly and with no delay. Also, the liquid may be dispensed in an open jet. At this point, a contact may be avoided between the proportioning device and a vessel for the liquid. Further, the proportioning device does not rely on an energy supply. It may be intuitively utilized by the user. Troublesome instructions or programming are unnecessary.

The disadvantage of manual proportioning devices is that working is tiresome because of the large force requirement.

Working frequently with manual proportioning devices can lead to damage to a person's health.

Electric proportioning devices drive the displacement device by means of an electric driving motor. The operator has to actuate electric push-buttons or switches to control the operations. Such proportioning devices have the advantage that their operation does not require considerable force.

However, the disadvantage is that the user does not receive a direct return information about the forces acting in the system, e.g. when the load rises as the pipette tip or syringe is clogged. Also, dispensing the liquid in an open jet is only possible to a limited extent. Work has to be stopped when the accumulator or battery is empty. Changes to the speed of liquid reception and delivery require to be programmed. Changes are mostly impossible during the proportioning operation.

U.S. Pat. No. 5,389,341 discloses a motor-driven pipette with an actuating button in which shifting an actuating button controls the movement of a piston via an electronic control system. The shifting of the actuating button is queried via an electronic path-detecting sensor and the result of query is electronically converted into the driving movement of the displacement device via a stepped motor. This electric proportioning device has the previously described disadvantages.

Accordingly, it is the object of the invention to provide a proportioning device which makes it easier or possible for the operator to obtain a tactile return information about the forces that act, to vary the speed of reception and delivery of the liquid during proportioning, to dispense the liquid in an open jet, and to easily use it, and which reduces the force required for actuation as compared to manually operated pipettes.

BRIEF SUMMARY OF THE INVENTION

The inventive proportioning device has a manually operable actuating device, a sensor associated with the actuating device for detecting a force manually exerted on the actuating device, an electric driving motor, an electric control connected to the sensor and electric driving motor for controlling the driving motor during the detection by the sensor of a force exerted on the actuating device, an electric voltage supply connected to the sensor, electric driving motor, and electronic control, and a displacement device coupled to the actuating device and electric driving motor for proportioning a liquid.

The inventive proportioning device is a combination of a manual and an electric proportioning device. The force applied by the operator to the actuating device is fed to the displacement device completely or partially. Additionally, the sensor detects the force exerted by the operator and the control controls the driving motor so as to feed the displacement device with an extra force which supports the force fed by the operator. As a consequence, the proportioning device can be operated by a fraction of the force to be applied in a manual proportioning device. In contrast to electric proportioning devices, the energy fed by the operator does not get lost, but is added to the driving energy of the motor. The driving motor only supports the force for an actuation of the displacement device. It need not position the displacement member of the displacement device (e.g. a piston or balloon-like end portion). The positioning procedure can be controlled by the operator and/or the mechanics of the proportioning device, e.g. a conventional limitation of the actuation path by means of a stop. This makes possible a particularly low-priced electric drive. More advantages of the proportioning device are:

The operator receives a tactile a tactile return information. Each variation of the force required for actuation is noticed immediately. The speed of liquid reception and delivery can be varied directly and with no delay. The delivery of liquid in an open jet is better than in a conventional manual proportioning device because the force of the operator and the force of the driving motor are summed up. The proportioning device may be used intuitively. Troublesome instructions or programming are unnecessary. The proportioning device can still be utilized even if the electric voltage supply is not available. e.g., when the battery is dead or not available. This situation may simply require a larger force to be applied to the actuating device. A motor or accumulator may be designed to be smaller than for a conventional proportioning device because these elements do not replace, but only complement the operator's energy.

According to an aspect, the actuating device is a actuating button manually displaceable in an axial direction. The proportioning device will then be operable like a conventional manual or electronic pipette or dispenser.

According to an aspect, the actuating device is operable against the force of a spring. This also corresponds to conventional pipettes or dispensers. The return motion of the actuating device may then be controlled by the force of the spring.

According to an aspect, the actuating device is operable until a stop is reached. As a result, the accurate position is fixed for the displacement member of the displacement device. This also corresponds to conventional manual pipettes or dispensers. A variability of the volume to be proportioned is also achievable by means of an adjustable stop in a conventional manner.

It is possible to make the sensor engage the actuating device from the outside. According to an aspect, the sensor is integrated into the actuating device. For example, it can be a plate-shaped pressure-sensitive sensor which is integrated in an actuating button perpendicular to the actuating device. According to another aspect, the sensor is integrated into an actuation surface of the actuating device. According to another aspect, the sensor is a Force Sensing Resistor (abbreviated FSR). An FSR sensor varies its electric resistance in response to the force applied to an active surface. The variation of resistance may be measured at connections of the sensor.

According to an aspect, the control constantly triggers the driving motor whenever the sensor detects a force manually exerted on the actuating device. For example, the driving motor may then overcome a general friction of the system completely or partially so that the operator only has to apply the additional force for shifting the displacement member and possibly some part of the system friction.

According to an aspect, the control controls the driving motor in response to the force detected by the sensor. According to another aspect, the control controls the driving motor in at least one stage with the level of the driving power increasing with the force detected by the sensor if several stages exist. According to an aspect, the control controls the driving motor proportionally to the force exerted on the sensor. According to an aspect, the control switches the driving motor off when the sensor detects a heavy increase of the force which is typical of the arrival at the stop.

According to an aspect, the actuating device and the driving motor are connected to the displacement device via a coupling device. The coupling device in question may be a set of gears. According to an aspect, the actuating device is connected to the displacement device via a rod. This makes possible a very simple construction, particularly when the displacement device is designed as a piston-and-cylinder unit. According to another aspect, the electric driving motor is coupled to the rod. This coupling is designed, for example, with a pinion which meshes with a set of teeth on a rack.

According to an aspect, the actuating button is operable until a stop connected to the rod bears on a fixed counter-stop.

The invention is applicable to all of the designs of proportioning devices mentioned at the beginning. Aspects refer to proportioning devices which have a displacement device with a piston in a cylinder, direct displacer and air-cushion proportioning devices. In a direct displacer proportioning device, the displacement device comprises a liquid reception volume having a through aperture to the environment, and in an air-cushion proportioning device, the displacement device is connected to a liquid reception volume having a through aperture to the environment According to an aspect, the actuating device is coupled to a device for detaching and/or dropping a pipette tip and/or syringe. The invention also reduces the expenditure in force for detaching and/or dropping a pipette tip and/or syringe.

According to an aspect, the proportioning device is a hand-operated proportioning device.

According to an aspect, the power supply has at least one accumulator and/or at least one battery.

BRIEF DESCRIPTION OF THE DRAWING

An embodiment of the inventive proportioning device will be described with reference to FIG. 1 which shows the proportioning device in a roughly schematic longitudinal section.

DETAILED DESCRIPTION OF THE INVENTION

Figure 1:
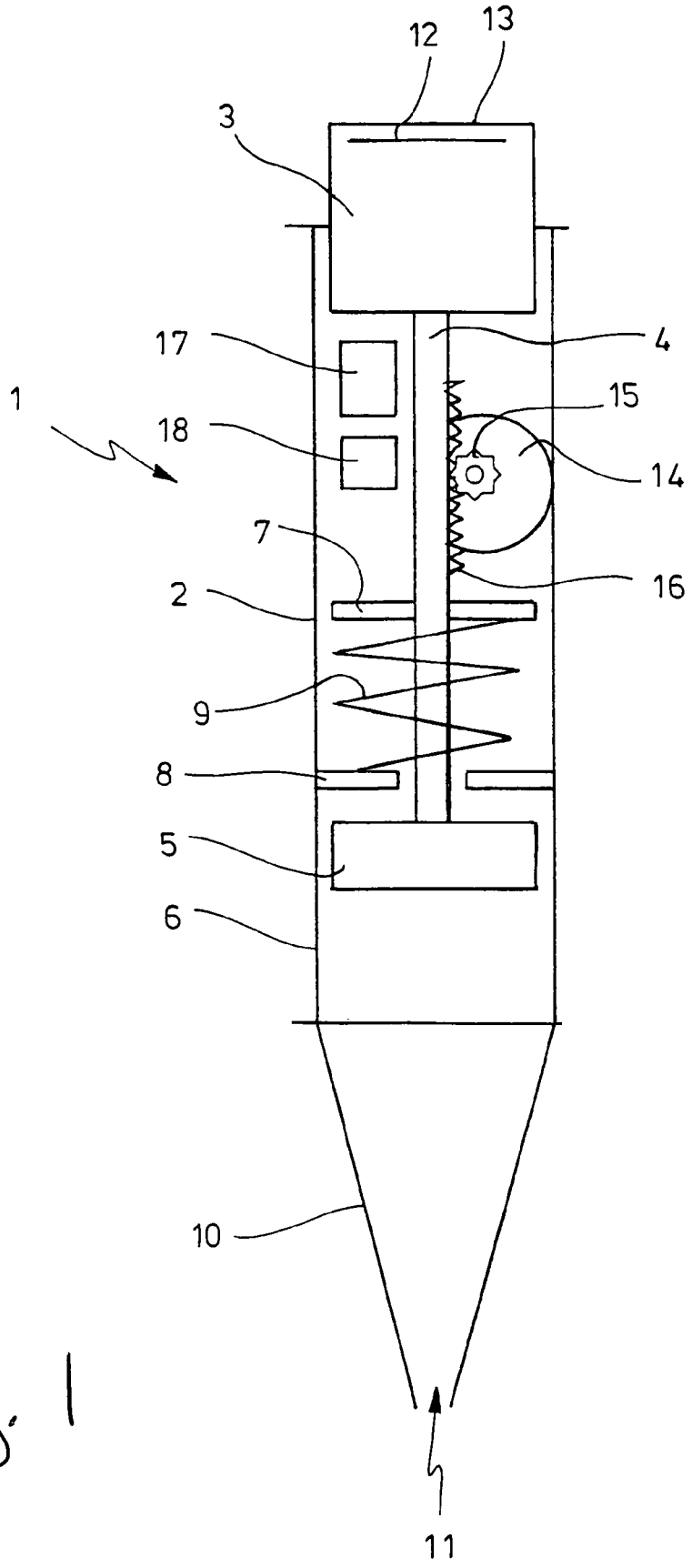

While this invention may be embodied in many different forms, there are described in detail herein a specific preferred embodiment of the invention. This description is an exemplification of the principles of the invention and is not intended to limit the invention to the particular embodiment illustrated The proportioning device 1 has a cylindrical casing 2 from which an axially operable actuating button 3 protrudes at top as is shown in FIG. 1.

The actuating button 3 is connected to a piston 5 via a rod 4. The piston 5 is guided in a cylinder 6.

A circular plate 7 is mounted on the rod 4. An annular disk 8 is fixed within the casing 2. A helical spring 9 is arranged between the circular disk 7 and annular disk 9.

A syringe or pipette tip 10 is fixed to the lower end of the casing 2. It is of a conical shape with a passage aperture 11 for liquid below.

In an aspect including a syringe 10, the cylinder 6 and piston 5 form part of the syringe. The casing 2 then has a connection to the cylinder 6 and the piston 5 has a connection to the rod 4.

In an aspect including a pipette tip 10, the cylinder 6 forms part of the casing and the piston 5 is permanently fixed to the rod 4.

The actuating button 3 has integrated therein a pressure sensor 12. It is associated with an actuation surface 13 of the actuating button 3 that is located outside.

The casing 2 houses an electric driving motor 14 the driving shaft of which carries a pinion 15 which meshes with a set of teeth 16 on the rod 4.

The casing 2 accommodates an electronic control 17 which is coupled to the pressure sensor 12 and the driving motor 14. The casing 2 also houses an accumulator 18 as a voltage supply to the pressure sensor 12, the driving motor 14, and the electronic control 17.

The force for operating the actuating button 3 is directly led into the piston 5 via the rod 4. In addition, the existence and level of a force is detected via the pressure sensor 4. The control 17 controls the driving motor 14 in response to the actuation force determined by the pressure sensor 12. As a consequence, the driving motor 14 propels the rod at a force which increases with an increase in force on the actuating button 3.

When the circular plate 7 is stopped by the annular disk 8 or completely compressed spring 9 and the operator releases the actuating button 3 the piston 5 and actuating button 3 are moved back to their initial position by the biased spring 9. The driving motor 14 which is under no tension allows the move back to the initial position.

When the piston 5 is shifted downwards air or liquid will be expelled from the syringe or pipette tip 10 and will be drawn in when it is oppositely shifted, in a known manner.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A proportioning device, comprising:

a manually operable actuating device (3), a sensor (12) associated with the actuating device (3) for detecting a force manually exerted on the actuating device (3), an electric driving motor (14), an electric control (17) connected to the sensor (12) and electric driving motor (14) for controlling the driving motor (14) during the detection by the sensor of a force exerted on the actuating device (3), the electric control (17) switching the electric driving motor (14) off when the sensor (12) detects a heavy increase in the force being applied to the actuating device (3), indicating that the actuating device (3) has reached a stop;

an electric voltage supply (18) connected to the sensor (12), electric driving motor (14), and electronic control (17), and a displacement device (5, 6) coupled to the actuating device (3) and electric driving motor (14) for proportioning a liquid.

2. The proportioning device according to claim 1 wherein the actuating device (3) is an actuating button manually displaceable in an axial direction and is operable against the force of a spring (9).

3. The proportioning device according to claim 1 wherein the actuating device (3) is operable until a stop (7, 8) is reached.

4. The proportioning device according to claim 1 wherein the sensor is integrated into an actuation surface (13) of the actuating device (3).

5. The proportioning device according to claim 1 wherein the sensor (12) is an FSR.

6. The proportioning device according to claim 1 wherein the control (17) constantly controls the driving motor (14) when a force is detected by the sensor (12).

7. The proportioning device according to claim 1 wherein the actuating device (3) and the driving motor (14) are connected to the displacement device (5, 6) via a coupling device (4).

8. The proportioning device according to claim 1 wherein the actuating device (3) is coupled to a device for detaching and/or dropping a pipette tip (10) and/or syringe.

9. The proportioning device according to claim 1 which is a hand-operated proportioning device (1).

10. The proportioning device according to claim 1 wherein the electric power supply (10) has at least one accumulator and/or at least one battery.

11. The proportioning device according to claim 1 wherein the actuating device (3) is connected to the displacement device (5, 6) via a rod (4) and further wherein the electric driving motor (14) is coupled to the rod (4).

12. The proportioning device according to claim 11 wherein the actuating device (3) is operable until a stop (7) connected to the rod (4) bears on a fixed counter-stop (8).

13. The proportioning device according to claim 1 wherein the control (17) controls the driving motor (14) in response to the force detected by the sensor (12).

14. The proportioning device according to claim 13 wherein the control (17) controls the driving motor (14) in at least one stage.

15. The proportioning device according to claim 13 wherein the control (17) controls the driving motor (14) proportionally to the force detected by the sensor (12).

16. The proportioning device according to claim 1 wherein the displacement device (5, 6) is a piston which is guided in a cylinder.

17. The proportioning device according to claim 16 wherein the displacement device (5, 6) is a detachable syringe (10).

18. The proportioning device according to claim 16 wherein the displacement device (5, 6) is connected to a detachable pipette tip (10).

* * * * *